United States Patent [19]

Muma

[11] Patent Number: 5,039,142

[45] Date of Patent: Aug. 13, 1991

[54] TOOL FOR TYING KNOTS IN BALLOONS

[76] Inventor: William T. Muma, 11847 Smoke Valley Ct., Maryland Heights, Mo. 63043

[21] Appl. No.: 504,131

[22] Filed: Apr. 3, 1990

[51] Int. Cl.[5] ..... D03J 3/00

[52] U.S. Cl. ..... 289/17; 289/2

[58] Field of Search ..... 289/1.5, 2, 13, 17, 289/18.1; 446/220, 222

[56] References Cited

U.S. PATENT DOCUMENTS

| | | | |
|---|---|---|---|
| 655,571 | 8/1900 | McCarthy | 289/17 |
| 1,680,318 | 8/1928 | Callahan | 446/222 |
| 2,396,906 | 3/1946 | Windson | 446/222 |
| 2,459,530 | 1/1949 | Johnston | 289/17 |
| 2,825,592 | 3/1958 | Semple | 289/17 |
| 2,882,645 | 4/1959 | Stivers | 446/222 |
| 3,106,417 | 10/1963 | Clow | 289/17 |
| 3,366,999 | 2/1968 | Darby | 24/81 |
| 3,476,423 | 11/1969 | Kentfield | 289/17 |
| 3,752,516 | 8/1973 | Muma | 289/17 |
| 3,783,551 | 1/1974 | Allison et al. | 446/222 |
| 3,837,691 | 9/1974 | Smythe | 289/17 |
| 4,661,081 | 4/1987 | Basseches | 446/220 |
| 4,798,554 | 1/1989 | Nelson et al. | 446/220 |
| 4,802,877 | 2/1989 | Davis | 446/222 |

*Primary Examiner*—Werner H. Schroeder
*Assistant Examiner*—Michael A. Neas
*Attorney, Agent, or Firm*—Senniger, Powers, Leavitt & Roedel

[57] ABSTRACT

A knot tying tool, for use with a balloon having a body and a neck integrally formed therewith, comprising an elongate member having an upper surface and a lower surface, first and second longitudinally opposite ends, first and second narrow slots extending inwardly from the first end of the elongate member, and a recess in the upper surface formed generally about the second slot. The first slot receives a portion of the neck generally at its base. The second slot receives the free end of the neck and holds the free end to facilitate pulling the free end through a loop formed by the balloon neck around the elongate member, to form a knot in the neck. The loop is formed, after insertion of the portion of the neck generally adjacent its base in the first slot, by winding a portion of the neck generally adjacent its free end transversely about the elongate member and around the base of the neck.

12 Claims, 1 Drawing Sheet

10
12
14
16
18
20
22
26
28
28A
30
32
36
36W
40
42
B
N
NB
NF
NR

TOOL FOR TYING KNOTS IN BALLOONS

BACKGROUND OF THE INVENTION

This invention relates generally to a tool for tying knots in balloons and a method for tying knots in balloons using the tool.

After a balloon has been inflated, the neck of the balloon is sealed off to prevent escape of the gas used to inflate the balloon. Although clamps or ties may be used to seal the balloon neck, more often than not, the neck is simply tied in a knot. Although the knots may be formed by hand, this method is entirely unsatisfactory where great numbers of balloons are required, such as for large celebrations, promotions, conventions and athletic events. A person's finger and hand muscles become fatigued after knotting numerous balloons, thus making the once simple manipulation difficult, which delays completion of the task. Further, the rubbing of the high friction balloon material against the fingers and hands while tying the balloon can irritate the skin, causing considerable discomfort. Therefore, there is presently a need for an aid to knotting a balloon, particularly when large numbers of balloons are to be knotted.

SUMMARY OF THE INVENTION

Among the several objects of the present invention may be noted the provision of a tool for knotting a balloon neck which may be used to quickly form a knot in the balloon neck; the provision of such a tool which is easy to manipulate, causing minimal fatigue to the user's fingers and hands so that a few people may knot large numbers of balloons without tiring; the provision of such a balloon knotting tool which allows the user to have only minimal skin contact with the high friction material of a balloon; and the provision of such a tool which is simple in design and inexpensive to manufacture.

It is also among the objects of the present invention to provide a method for knotting a balloon neck using the tool which can be performed quickly and with a minimum of contact between the skin and the balloon material.

Generally, a knot tying tool, constructed according to the principals of the present invention, comprises an elongate member having an upper surface and a lower surface, first and second longitudinally opposite ends, first and second narrow slots extending inwardly from the first end of the elongate member and a recess in the upper surface formed generally about the second slot. The tool is for use with a balloon which includes a body and a neck integrally formed therewith through which air or other gas is received for inflating the balloon body. The balloon neck has a base adjacent the body, and a free end opposite the base. The first slot in the elongate member is adapted to receive a portion of the neck generally adjacent its base therein. The second slot is adapted to receive a portion of the neck generally adjacent its free end therein with the free end of the neck being received in the recess. The free end of the neck is held in the recess to facilitate pulling it through a loop to form a knot in the neck. The loop is formed, after insertion of the portion of the neck generally adjacent its base into the first slot, by winding a middle portion of the neck transversely about the elongate member and around the base of the neck.

In another aspect of the present invention, a method for tying a knot in a balloon includes the steps of providing the balloon knotting tool a described and inserting a portion of the neck generally at its base in the first slot of the elongate member with the free end of the neck above the upper surface of the elongate member. A loop is formed about the elongate member by pulling the portions of the neck above the upper surface of the elongate member over the upper surface in a direction transverse to the lengthwise extension of the elongate member, toward the second slot, around its side, under the lower surface, and around the base of the neck below said first slot. A portion of the neck adjacent its free end is inserted into the second slot with the free end received in the recess in the upper surface of the elongate member. The balloon neck is removed from the elongate member with the free end of the balloon neck passing through the loop to form a knot in the neck upon withdrawal of the tool from the loop.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF A PREFERRED EMBODIMENT

Figures 1, 2, 3, 4, 5, 6, 7:
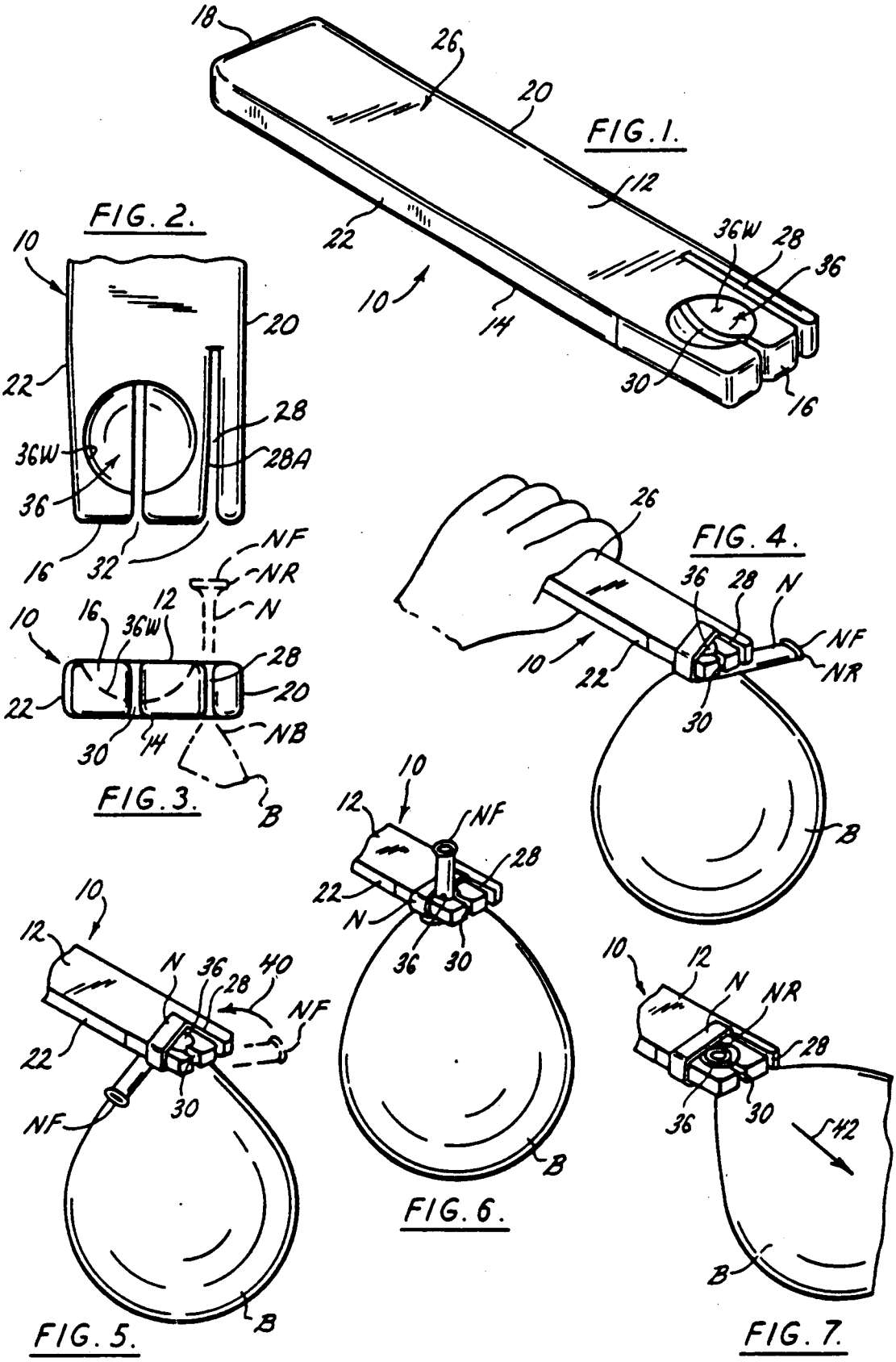
FIG. 1 is a perspective of the balloon knotting tool.
FIG. 2 is a fragmentary plan view of the balloon knotting tool.
FIG. 3 is an elevation of the first end of the tool.
FIGS. 4–7 illustrate the use of the tool to knot a balloon neck.

Referring now to the drawings and specifically to FIG. 1, a balloon knotting tool constructed according to the principals of the present invention is shown to comprise an elongate member, indicated generally at 10, having an upper surface 12 and a lower surface 14, a first end 16, a second end 18 longitudinally opposite the first end, a first side 20, and a second side 22. The elongate member 10 may be made of wood or other material which can be formed with a smooth surface. The tool is designed for use with a balloon made of elastic material including a body B and a neck N integrally formed with the body. Air or other gas is received through a passage in the neck to inflate the body B. The neck includes a base NB adjacent the body, and a free end NF opposite the base. A relatively thick annular rim NR is located at the free end of the neck.

The portion of the elongate member 10 generally adjacent the second end 18 defines a handle 26 for grasping the tool during use (FIG. 4). First and second narrow slots, indicated at 28 and 30, respectively, extend inwardly from the first end 16 of the elongate member and are adapted to receive portions of the balloon neck N. As shown in FIG. 2, each slot has a mouth 32 at the first end 16 of the elongate member which flares outwardly providing a V-shaped, funnel-like entrance for portions of the balloon neck N to be inserted into the narrow portions of the slots. The width of the first slot 28 in its narrow portion is approximately 0.08 inches and the width of the 30 second slot 30 is approximately 0.05 inches. It is to be understood that the precise width of the slots 28, 30 may vary somewhat and still fall within the scope of the present invention. The width of the slots 28, 30 relative to the width of the elongate member 10, as illustrated in the drawings, has been exaggerated for clarity.

As shown in FIG. 2, the first slot 28 is defined in part by a laterally inner wall 28A. The laterally inner wall and the second side 22 of the elongate member converge toward the first end 16 of the elongate member. Thus, the lateral dimension of the elongate member 10 between the second side 22 and the inner wall 28A of the first slot tapers toward the first end 16 of the elongate member. The angle of taper of the inner wall 28A and the second side 22 with respect to the direction of longitudinal extension of the elongate member is not substantially greater than 10°. A recess generally indicated at 36, and formed in the upper surface 12 of the elongate member is generally symmetric about the first slot 28. As will be discussed more fully below, the recess 36 facilitates formation of the knot in the balloon neck N by holding the free end NF of the neck therein. It is to be understood that the reference to "upper" and "lower" surface are used to establish a consistent frame of reference for describing the tool and are not limitations on the orientation of the tool for use.

The method of the present invention, illustrated in FIGS. 4–7 of the drawings, involves the provision of a balloon knotting tool as described above. A portion of the balloon neck N generally adjacent its base is inserted into the first slot 28 and positioned at the bottom (or longitudinally inward end) of the slot. As shown in FIG. 3, the balloon body B and the base NB of the neck are disPosed below the lower surface 14 of the elongate member 10, and the free end NF and adjacent portions of the neck are disposed above the upper surface 12.

A loop is formed about the elongate member 10 by winding the free end NF and portions generally adjacent thereto around the elongate member. More specifically, the neck N is grasped generally at its free end NF, and portions of the neck above the upper surface generally adjacent the free end are pulled over the upper surface in a direction transverse to the lengthwise extension of the elongate member 10, generally toward the second slot 30. Pulling the neck N across the upper surface 12 pinches off the neck so that no gas may escape from the balloon body. In another embodiment of the present invention (not shown), the width of the narrow portion of the first slot 28 is sized to pinch off the neck N upon insertion of the neck therein. Because the first slot 28 is longer than the second slot 30, the neck N does not substantially overlap the second slot as it is pulled over the upper surface 12. The neck N is then pulled around the second side 22 of the elongate member, and under the lower surface 14 to a position in which the free end NF is located next to the base NB of the neck (FIG. 4). From this position (shown in phantom in FIG. 5), the free end NF and adjacent portions of the neck are pulled around the base in the direction indicated by the arrow 40 in FIG. 5 to complete the formation of the loop.

As shown in FIG. 6, the portion of the neck N adjacent its free end NF is then inserted into the second slot 30 and with the free end positioned generally over the recess 36 in the upper surface 12. The free end NF of the balloon is then released and, because of the stretching of the elastic balloon material while it has been wound around the elongate member 10, the free end snaps down into the recess 36, so that the free end of the neck N is withdrawn from the upper surface 12. The relatively thick rim NR prevents the free end NF from being pulled downwardly through the second slot 30.

In order to complete the formation of the knot in the balloon neck N, the tool must be withdrawn from the loop just formed by the neck, with the free end NF of the neck pulled back through the loop. This is accomplished by holding the balloon stationary and pulling the tool out of the loop, or equivalently by holding the tool stationary and pulling the balloon in the direction indicated by the arrow 42 in FIG. 7. In the recess 36, the free end NF of the neck is withdrawn from the upper surface 12, so there will be no engagement of any other portion of the balloon neck N with the free end when the neck is pulled off the elongate member 10. Therefore, the free end NF will not be inadvertently pushed out of the second slot 30 by the portion of the neck N wound over the upper surface 12 of the elongate member 10 as that portion slides off the elongate member. Therefore, the free end NF will pass through the loop before the free end is released from the recess 36, so that a knot is formed in the neck.

During the step of removing the balloon neck N from the elongate member 10, the elongate member is preferably oriented substantially parallel to or slightly elevated at its first end 16 with respect to the direction of motion. This relative orientation helps to maintain the free end NF in the recess 36. As the balloon is pulled, the portion of the neck N wound around the elongate member 10 to form the loop slides along the elongate member with the portion of the neck in the first slot 28 moving outwardlY therefrom. The tapering lateral dimension of the elongate member 10 between the second side 22 and the inner wall 28A of the first slot toward the first end 16 of the elongate member allows the neck to more easily slide off the elongate member. As stated above, the angle of taper of the elongate member at the second side 22 and at the inner wall 28A is generally 10° or less. At angles of taper substantially greater than 10°, the balloon neck tends to slide off the elongate member 12 prior to formation of the loop. The free end NF may be released from the recess 36 by pivoting the first end 16 of the elongate member downward and pulling the balloon neck slightly upward and outward.

The recess 36 in the upper surface 12 of the elongate member 10 facilitates holding the free end NF of the balloon neck in the second slot 30 in two ways. The formation of the recess 36 includes the creation of a generally vertical wall 36W extending into the elongate member from the upper surface. In the preferred embodiment, a single, curved wall 36W is generally vertical at the periphery of the recess 36 and generally horizontal in the center of the recess. However, the recess 36 could be defined in other ways, such as by multiple generally planar vertical walls 36W, and still fall within the scope of the present invention.

As the balloon body B is pulled in a direction indicated by arrow 42 in FIG. 7 in the final step of tying the knot, a force is applied tending to move the free end NF out of the second slot 30 in a direction generally parallel to the length of the slot (as indicated by arrow 42). However, by maintaining the elongate member 10 in an orientation substantially parallel to or with its first end 16 elevated with respect to the direction of motion, the relatively thick rim NR at the free end of the neck will engage the generally vertical wall 36W of the recess to hold the free end NF against such movement. In addition to the recess 36, the narrow width of the second slot 30 also helps to hold the portion of the neck N received in the slot. To remove the free end NF from the recess 36, the elongate member 10 is oriented so that no wall of the recess is positioned in the path of the direction of motion of the free end. As described above, a preferred, but not exclusive way of accomplishing this is by pivoting the first end of the elongate member downward, and pulling the balloon neck upward and outward from the recess and second slot.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A knot tying tool for use with a balloon having a body and a neck integrally formed therewith, the neck being shaped to receive a gas therethrough for inflating the balloon body, the neck having a base adjacent the body and a free end opposite the base, the tool comprising an elongate member having an upper surface and a lower surface, first and second laterally opposite sides, first and second longitudinally opposite ends, first and second narrow slots extending inwardly from the first end, and a recess in the upper surface formed generally about the second slot, the first slot being shaped to receive a portion of the neck generally adjacent its base therein, the second slot being shaped to receive a portion of the neck adjacent its free end therein with the free end being received in the recess for holding the free end of the neck to facilitate pulling the free end through a loop to form a knot in the neck, the loop being formed after insertion of the portion of the neck generally adjacent its base into the first slot by winding a portion of the neck generally adjacent its free end transversely about the elongate member and around the base of the neck.

2. A tool as set forth in claim 1 wherein the first slot is longer than the second slot.

3. A tool as set forth in claim 1 wherein the first and second slots each have a laterally outwardly flaring mouth at the first end of the elongate member to facilitate insertion of a portion of the balloon neck in the slots.

4. A tool as set forth in claim 3 wherein the first slot is defined in part by a laterally inner wall, and wherein the lateral dimension of the elongate member between the second side thereof and the laterally inner wall of the first slot tapers toward the first end of the elongate member to facilitate withdrawal of the balloon neck from the tool.

5. A tool as set forth in claim 4 wherein the angle of taper of the elongate member at the laterally inner wall of the slot and at the second side of the elongate member is not substantially greater than 10°.

6. A tool as set forth in claim 4 wherein the first slot has a width sized to pinch off the neck therein to prevent gas from escaping the body of the balloon.

7. A tool as set forth in claim 1 wherein the recess is substantially symmetric about the second slot.

8. A knot tying tool for use with a balloon having a body and a neck integrally formed therewith, the neck being shaped to receive a gas therethrough for inflating the balloon body, the neck having a base adjacent the body and a free end opposite the base, the tool comprising an elongate member having an upper surface and a lower surface, first and second laterally opposite sides, first and second longitudinally opposite ends, first and second narrow slots extending inwardly from the first end, and a recess in the upper surface formed generally about the second slot, the first and second slots each including a laterally outwardly flaring mouth at the first end of the elongate member to facilitate insertion of a portion of the balloon neck in the slots, the first slot being longer than the second slot and defined in part by a laterally inner wall, the first slot being shaped to receive therein a portion of the neck generally adjacent its base, the second slot being shaped to receive the free end of the neck therein for holding the free end of the neck to facilitate pulling the free end through a loop to form a knot in the neck, the loop being formed after insertion of the portion of the neck adjacent its base into the first slot by winding a portion of the neck generally adjacent its free end transversely about the elongate member and around the base of the neck, and wherein the lateral dimension of the elongate member between the second side thereof and the laterally inner wall of the first slot tapers toward the first end of the elongate member to facilitate withdrawal of the balloon neck from the tool.

9. A tool as set forth in claim 8 wherein the first slot has a width sized to pinch off the neck therein to prevent gas from escaping the body of the balloon.

10. A tool as set forth in claim 9 wherein the recess is substantially symmetric about the second slot.

11. A tool as set forth in claim 8 wherein the angle of taper of the elongate member at the laterally inner wall of the slot and at the second side of the elongate member is not substantially greater than 10°.

12. A method for tying a knot in a balloon including a body and a neck integrally formed therewith, the neck being shaped to receive a gas therethrough for inflating the balloon body, the neck having a base adjacent the body and a free end opposite the base, the method comprising, providing a knot tying tool comprising an elongate member having an upper surface and a lower surface, first and second longitudinally opposite ends, first and second sides, first and second narrow slots extending inwardly from the first end and a recess in the upper surface formed generally about the second slot, inserting a portion of the neck generally adjacent its base in he first slot of the elongate member with the balloon body disposed below the lower surface of the elongate member, forming a loop about the elongate member by pulling portions of the neck above the upper surface of the elongate member over the upper surface in a direction transverse to the lengthwise extension of the elongate member toward the second slot, around the second side, under the lower surface, and around the base of the neck, inserting a portion of the neck adjacent its free end into the second slot with the free end being received in the recess, and removing the balloon neck from the elongate member such that the free end of the balloon neck passes through the loop to form a knot in the neck.

* * * * *